United States Patent [19]

Pingleton et al.

[11] Patent Number: 4,462,525

[45] Date of Patent: Jul. 31, 1984

[54] PORTABLE TELEVISION EQUIPMENT CARRIER

[76] Inventors: Robert W. Pingleton; Frank J. Downs, both of 2122 Walton Way, Newberry, S.C. 29108

[21] Appl. No.: 483,215

[22] Filed: Apr. 8, 1983

[51] Int. Cl.[3] ..... A45F 3/04

[52] U.S. Cl. ..... 224/210; 224/908

[58] Field of Search ..... 224/151, 153, 155, 160, 224/161, 209, 210, 211, 212, 259, 261, 263, 908, 213; D3/32

[56] References Cited

U.S. PATENT DOCUMENTS 3,292,830 12/1966 Mack .

FOREIGN PATENT DOCUMENTS 861216 10/1940 France ..... 224/213

*Primary Examiner*—Steven M. Pollard

*Assistant Examiner*—David Voorhees

[57] ABSTRACT

This carrier is for retaining a television camera and its operating accessories, such as wires, batteries, etc. Primarily, it consists of a tubular frame attached to a case, which may be back-carried or hand-carried, as desired. It also includes a pair of shoulder straps, and a hand carry strap, and it is adjustable to fit people of various sizes, and enables them to travel with their equipment on airplanes, buses and other vehicles, wherein they can watch their equipment, and it is also readily available for instant use.

1 Claim, 4 Drawing Figures

FIG. 1
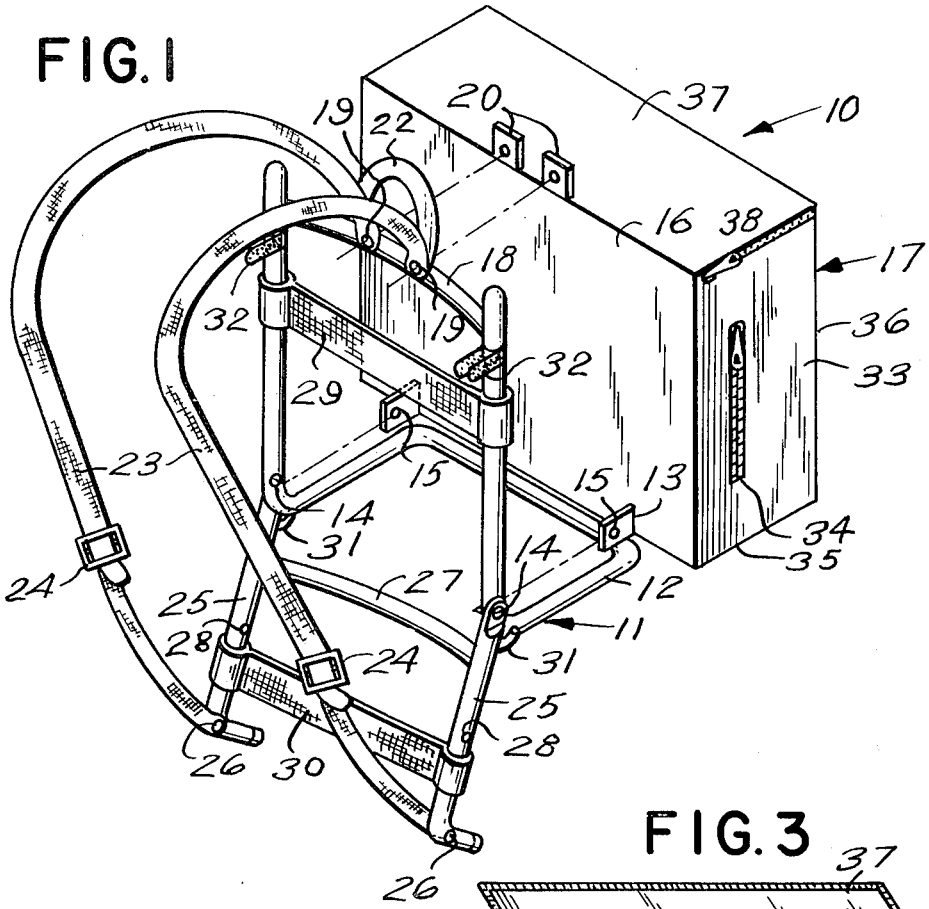
FIG. 2
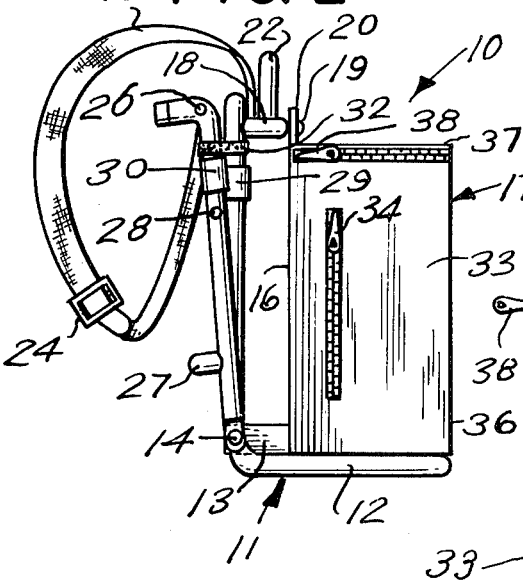
FIG. 3
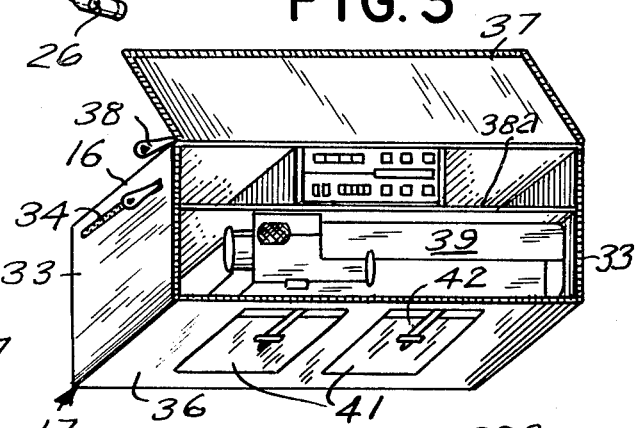
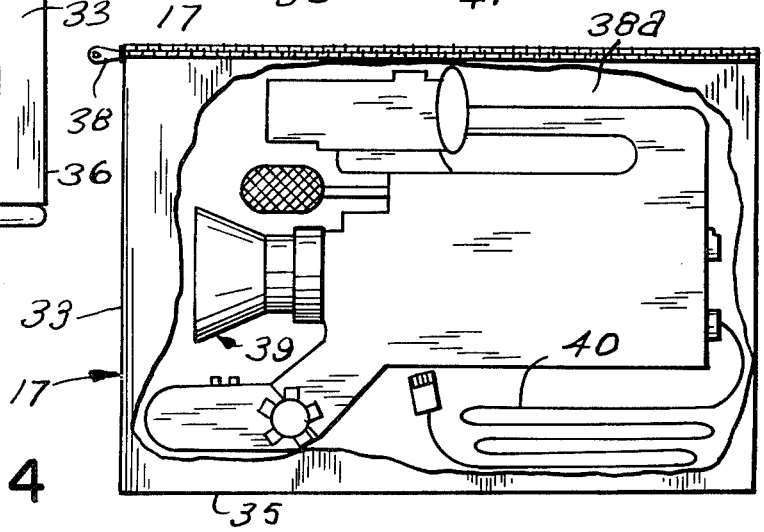
FIG. 4

PORTABLE TELEVISION EQUIPMENT CARRIER

This invention relates to backpacks, and more particularly, to a portable television equipment carrier.

The principal object of this invention is to provide a portable television equipment carrier, which will be employed to carry all three major pieces of home television equipment, such as the VCR, camera, and batteries.

Another object of this invention is to provide a portable television equipment carrier, which will be comfortable to the user, and will house all of the necessary wires and other accessories.

Another object of this invention is to provide a portable television equipment carrier, which not only will be comfortable to carry, but will also enable its user to employ the equipment to photograph, because the unit is completely mobile.

A further object of this invention is to provide a portable television equipment carrier, which will be of such design, as to enable the user to place it under his seat, rather than in storage, when traveling by airplane or bus, and the equipment will be readily available when needed.

A still further object of this invention is to provide a portable television equipment carrier, which will enable the user to have his equipment where he can watch it, and prevent damage or theft thereof.

An even further object of this invention is to provide a portable television equipment carrier, which will enable the user to slip on the carrier, so as to have his hands free to carry luggage, or children, when transferring from an automobile to an airplane, and the carrier eliminates the need to buy a separate bag or case for the storage of the camera, when it is not being used.

Other objects are to provide a portable television equipment carrier, which is simple in design, inexpensive to manufacture, rugged in construction, easy to use, and efficient in operation.

These, and other objects, will be readily evident, upon a study of the following specification, and the accompanying drawing, wherein:

FIG. 1 is a perspective view of the present invention, illustrating the case detached from its frame;

FIG. 2 is a side elevational view of FIG. 1, showing the frame attached to the case, with the lower portion of the frame illustrated in folded condition;

FIG. 3 is a perspective view of the case, shown detached from its frame, and illustrating the cover in open condition, and FIG. 4 is a front elevational view of the case, shown partly broken away.

Accordingly, a carrier 10 is shown to include a tubular aluminum frame 11, consisting of main support member 12, which is fastened at its lower portion to a pair of mounting flaps 13, by suitable fasteners 14. Fasteners 14 are received in the openings 15 of flaps 13, and flaps 13 project from, and are fixedly secured to, the rear panel 16 of case 17, in a suitable manner, not shown. An arcuate cross-member 18 is fixedly secured to the top portion of main support member 12, at its ends, in a suitable manner, and a pair of fasteners 19 serve to secure member 18 to a second pair of flaps 20, by being received in the openings 21 thereof. A hand strap 22 is also secured, at each end, to cross-member 18 by fasteners 19, and fasteners 19 serve to secure one end of the shoulder straps 23 to member 18 further. Straps 23 are adjustable by buckles 24, and are secured, at their opposite ends, to legs 25, by means of suitable fasteners 26. Legs 25 are pivotally secured, at their upper ends, to main support member 12, by the heretofore described fasteners 14, and a second arcuate cross-member 27 is fixedly secured, at its ends, to legs 25. A pair of transverse openings 28, through legs 25, serve as a secondary placement of the lower ends of shoulder straps 23, by the use of fasteners 26, when desired, and an adjustable elastic back strap 29 is provided, and is secured, at its ends, to main support frame 11. A hip strap 30 is also provided, and is secured, at its ends, to the legs 25, and it shall be noted, that straps 29 and 30 are slidable up and down, on their respective member 12 and 25. An arcuately configurated stop member 31 is fixedly secure at one end, in a suitable manner, to the upper portions of legs 25, so as to engage under the lower portion of main support member 12, which will serve to keep the legs 25 at an angle. A pair of mating Velcro fastener strips 32 are each fixedly secured to the upper portions of main support member 12, in a suitable manner, and serve to hold legs 25 in the folded upward condition, when desired. Case 17 includes a pair of side panels 33, one with a zipper 34, which closes a pocket, not shown, and a bottom wall 35, a front wall 36, and a hinged cover 37 includes a zipper 38 for closing case 17. Case 17 also includes a divider wall **38*a*, so as to provide compartments for the television camera 39, cables 40, etc. The front walls 36 also includes a pair of pockets 41, having straps 42 for closure, and pockets 41 serve to contain the batteries for the camera 39**.

In use, the frame 11 of carrier 10 is placed on the user's back, and is held in place by the adjustable straps 23. The straps 29 and 30 are adjustable to the size of the user, by raising or lowering them, and, when desired, the legs 25 may be pivoted upward and held in place by the Velcro fasteners 32.

It shall also be noted, that the batteries stay in their respective pockets 41, and are rechargeable after each use, while the carrier legs 25 are folded upward, and the design of carrier is such, that it will fit almost any size of height of a user.

While various changes may be made in the detail construction, it is understood that such changes will be within the spirit and scope of the present invention, as is defined by the appended claims.

We claim:

1. A portable television equipment carrier, comprising, in combination, a case for containing home television equipment, and a tubular aluminum frame upon which said case is mounted, said frame including means for being carried upon a person's back, said frame comprising a main support member and a pair of legs pivotally attached to said main support member; said main support member comprising a configurated tube formed with parallel "L"-shaped portions at its opposite ends and a straight interconnecting portion between corresponding one ends of said "L"-shaped portions, for forming a framework upon which said case is placed, an arcuate cross-piece and an elastic back strap between corresponding opposite ends of said "L"-shaped portions, for resting against said person's back; each said leg being pivoted at one end from a right angle corner formed on each said "L"-shaped portion, a hip strap between said legs, a pair of adjustable shoulder straps attached from said arcuate cross-piece to a free opposite end of each said leg, and said case being affixed to said frame by means of flaps.

* * * * *